US009899722B2

(12) United States Patent
Saraf

(10) Patent No.: US 9,899,722 B2
(45) Date of Patent: Feb. 20, 2018

(54) ANTENNA FORMED FROM PLATES AND METHODS USEFUL IN CONJUNCTION THEREWITH

(71) Applicant: MTI WIRELESS EDGE, LTD., Rosh Ha'Ayin (IL)

(72) Inventor: Israel Saraf, Beit-El (IL)

(73) Assignee: MTI WIRELESS EDGE, LTD., Rosh Ha'Ayin (IL)

( * ) Notice: Subject to any disclaimer, the term of this patent is extended or adjusted under 35 U.S.C. 154(b) by 205 days.

(21) Appl. No.: 14/995,568

(22) Filed: Jan. 14, 2016

(65) Prior Publication Data

US 2016/0211582 A1 Jul. 21, 2016

(30) Foreign Application Priority Data

Jan. 15, 2015 (IL) ..... 236739

(51) Int. Cl.

| | |
|---|---|
| ***H01Q 13/10*** | (2006.01) |
| ***H01P 5/19*** | (2006.01) |
| ***H01Q 21/00*** | (2006.01) |
| ***H01Q 21/06*** | (2006.01) |

(52) U.S. Cl.
CPC ..... *H01P 5/19* (2013.01); *H01Q 21/0025* (2013.01); *H01Q 21/064* (2013.01)

(58) Field of Classification Search
CPC ..... H01C 21/964; H01C 13/02; H01P 5/19
See application file for complete search history.

(56) References Cited

U.S. PATENT DOCUMENTS

| | | | | |
|---|---|---|---|---|
| 4,743,915 | A | 5/1988 | Rammos et al. | |
| 4,783,663 | A | 11/1988 | Rammos et al. | |
| 5,243,357 | A | 9/1993 | Koike et al. | |
| 5,337,065 | A * | 8/1994 | Bonnet | H01Q 13/18 343/700 MS |
| 5,568,160 | A | 10/1996 | Collins | |
| 5,926,147 | A * | 7/1999 | Sehm | H01Q 21/0087 343/771 |
| 6,034,647 | A | 3/2000 | Paul et al. | |

(Continued)

FOREIGN PATENT DOCUMENTS

| | | | |
|---|---|---|---|
| GB | 2247990 | A | 3/1992 |
| WO | 8909501 | A1 | 10/1989 |
| WO | 2013089456 | A1 | 6/2013 |

*Primary Examiner* — Dieu H Duong
(74) *Attorney, Agent, or Firm* — Browdy and Neimark, PLLC

(57) ABSTRACT

An antenna array configuration is provided with h-plane splitters between ends of a feeding network and radiating elements e.g. horns, thereby to reduce the distance between the centers of the horns to less than one wavelength which results in a better side lobe level. A method of manufacturing upper and lower plates together constituting an antenna is also provided, typically making each plate in a single operation, by dividing the feeding network's waveguides at the centre where there are no cross currents so as not to disturb propagation in the feeding network. The radiating elements, h-plane splitters and upper half of the feeding network may be fabricated in one plate without undercuts hence simplifying manufacture of the plate which may for example be formed using a simple molding machine or a 3 axis-CNC machine.

19 Claims, 7 Drawing Sheets

(56) References Cited

U.S. PATENT DOCUMENTS

| | | | | |
|---|---|---|---|---|
| 6,101,705 | A * | 8/2000 | Wolfson | H01Q 13/28 29/600 |
| 6,563,398 | B1 | 5/2003 | Wu | |
| 6,897,824 | B2 | 5/2005 | Gerhard | |
| 7,564,421 | B1 | 7/2009 | Edwards et al. | |
| 8,558,746 | B2 | 10/2013 | Thomson et al. | |
| 2006/0158382 | A1 | 7/2006 | Nagai | |
| 2013/0120205 | A1 | 5/2013 | Thomson et al. | |
| 2013/0321229 | A1 | 12/2013 | Klefenz et al. | |

* cited by examiner

ANTENNA FORMED FROM PLATES AND METHODS USEFUL IN CONJUNCTION THEREWITH

FIELD OF THIS DISCLOSURE

The present invention relates generally to antennae and more particularly to antenna arrays.

BACKGROUND FOR THIS DISCLOSURE

State of the art antenna technology includes that described in the following patent documents: US 20130120205; US 20130321229; U.S. Pat. Nos. 4,743,915; 4,783,663; 5,243,357; 5,568,160; 6,034,647; 6,563,398; 6,897,824; 7,564,421; 8,558,746; WO2013089456A1; and U.S. Pat. No. 4,743,915 to Rammos (Philips).

The disclosures of all publications and patent documents mentioned in the specification, and of the publications and patent documents cited therein directly or indirectly, are hereby incorporated by reference. Materiality of such publications and patent documents to patentability is not conceded.

SUMMARY OF CERTAIN EMBODIMENTS

Certain embodiments of the present invention seek to provide an antenna array configuration with h-plane splitters between ends of a feeding network and radiating elements e.g. horns, thereby to reduce the distance between the centers of the horns to less than one wavelength which results in a better side lobe level.

Certain embodiments of the present invention seek to manufacture upper and lower plates together constituting an antenna, typically each plate in a single operation, by dividing the feeding network's waveguides at the centre where there are no cross currents so as not to disturb propagation in the feeding network. An advantage of certain embodiments is that propagation in the feeding network remains undisturbed even if the two halves of the waveguides are not touching each other and instead are bonded to one another, generating a non-zero gap there between. For example, the two plates of the antenna may be attached to one another only by screws, rather than soldering the plates together.

According to certain embodiments of the present invention the radiating elements, h-plane splitters and upper half of the feeding network are fabricated in one plate without undercuts hence simplifying manufacture of the plate which may for example be formed using a simple molding machine or a 3 axis-CNC machine. Parts with undercuts require an extra part for the mold and increase the cost of the molded part.

The following terms may be construed either in accordance with any definition thereof appearing in the prior art literature or in accordance with the specification, or as follows:

Waveguide—metallic hollow pipe which may have a rectangular or elliptical or oval profile (cross-section) used for conveying electromagnetic waves from one opening of the pipe to another.

Cutoff frequency: The frequency corresponding to a wavelength of 2a, given a rectangular waveguide with dimensions a×b, where a>b, e.g. as shown in FIG. 1*a*. This is because such a waveguide can transmit signals whose wavelengths satisfy $$\frac{\lambda}{2} < a$$

where "a" is the larger cross-sectional dimension.

Two plate waveguide—The waveguide may be manufactured from two plates in any suitable manner e.g. by cutting channels in the two conductive plates and then attaching the plates e.g. as shown in FIG. 1*b*.

E-plane orientation waveguide—a waveguide made from two conductive pieces in which the narrow wall of the waveguide "b" is parallel to the conductive plates. Such a configuration allows the waveguide to be divided between the plates such the division line does not cross electric current lines as explained herein and/or as known in the art.

E-orientation waveguide feeding network: A planar feeding network including E-plane splitters interconnected by waveguide sections. The waveguide orientation is such that the short dimension of the waveguide's cross-section "b" is parallel to the plane of the feeding network.

E-plane splitter—A waveguide power divider in which the input branch connects to the long wall "a" of the waveguide e.g. as shown in FIG. 2*a*. In an E-plane splitter the phases of the wave at the splitter outputs are opposite.

H-plane splitter—A waveguide power divider in which the input branch connects to the short wall "b" of the waveguide e.g. as shown in FIG. 2*b*. In an H-plane splitter the phases of the wave at the splitter outputs are equal.

Radiating element: A component with one input and one output in which the input is connected to a previous component and the output opens to free space hence radiates power into space. Radiating element may for example comprise: small horn antennas, rectangular waveguides with one end open to the space, circular or hexagonal waveguides with one end open to the space, and so forth.

Feeding network: Components of an antenna array which, in a transmitting antenna, feed radio waves arriving from the antenna input to the array of radiating elements (which are functioning as transmitting elements), or, in a receiving antenna, collect the incoming radio waves from the various radiating elements in the array (which are functioning as receiving elements), and sum radiation from all such elements into the antenna "input" (which in receiving antenna functions as output).

Undercut: A feature that cannot be molded using only a single pull mold.

The present invention thus typically includes at least the following embodiments:

Embodiment 1: Antenna apparatus for transmitting/receiving electromagnetic radiation defining a wavelength, the apparatus comprising:

at least one lower machined plate; and at least one upper machined plate including:

a radiating element layer including an array of radiating elements each having a center, wherein the distance between the centers of adjacent elements in the array is less than one wavelength; and an H-plane splitter layer below the radiating element layer and including H-plane splitters each having an H-plane splitter input facing the lower plate and a pair of H-plane splitter outputs which respectively connect the H-plane splitter to a pair of the radiating elements, and an E-orientation feeding network layer having an input and comprising:

E-plane splitters receiving the wave from the feeding network input and defining multiple feeding network outputs, wherein an individual H-plane splitter input connects individual ones of the H-plane splitters to respective outputs from among the multiple feeding network outputs, thereby to enable the H-plane splitters to split the electromagnetic radiation travelling from the feeding network input to the radiating elements, and wherein each E-plane splitter is formed of first and second halves which are included in the upper and lower plates respectively; and hollow (e.g. rectangular) waveguide sections configured for interconnecting the E-plane splitters, e.g. configured for connecting an output of an E-plane splitter to an input of a subsequent E-plane splitter, and including first and second halves which are disposed on respective sides of a bisecting plane parallel to the waveguide's shorter cross-sectional dimension and which are included in the lower and upper plates respectively.

Embodiment 2. Antenna apparatus according to any of the preceding embodiments wherein the radiating element layer, H-plane splitter layer and E-orientation feeding network layer are formed from only two machined plates.

Embodiment 3. Antenna apparatus according to any of the preceding embodiments wherein the radiating element layer, H-plane splitter layer and E-orientation feeding network layer are formed by injection molding two machined plates.

Embodiment 4. Antenna apparatus according to any of the preceding embodiments wherein the radiating element layer, H-plane splitter layer and E-orientation feeding network layer are formed by injection molding only two machined plates.

Embodiment 5. Antenna apparatus according to any of the preceding embodiments wherein the E-plane splitters are arranged to form a parallel feeding network defining a binary tree comprising layers of splitters, each splitter in a layer n splitting an output of a splitter in layer (n−1) of the tree.

Embodiment 6. Antenna apparatus according to any of the preceding embodiments wherein the at least one upper machined plate comprises a middle plate and a top-most plate, and wherein:

the radiating element layer is included in the top-most plate;

first and second portions of the H-plane splitter layer are included in the middle and top-most plates respectively; and the hollow rectangular waveguide's first and second halves are included in the middle and lower plates respectively; and each E-plane splitter's first and second halves are included in the middle and lower plates respectively.

Embodiment 7. Antenna apparatus according to any of the preceding embodiments wherein there is no undercut in the lower plate.

Embodiment 8. Antenna apparatus according to any of the preceding embodiments wherein at least one of the E-plane splitters has first and second outputs and is designed to split power unequally between the first and second outputs.

Embodiment 9. Antenna apparatus according to any of the preceding embodiments wherein paths from the feeding network input to each of the outputs are equal in length so phases at all of the multiple feeding network outputs are identical.

Embodiment 10. Antenna apparatus according to any of the preceding embodiments wherein the network layer comprises a full binary tree.

Embodiment 11. Antenna apparatus according to any of the preceding embodiments wherein the plates may be screwed, rather than being soldered, to one another.

Embodiment 12. A method for manufacturing an antenna for transmitting/receiving electromagnetic radiation defining a wavelength and comprising:

providing a hollow waveguide made from first and second waveguide halves which are disposed on respective sides of a bisecting plane disposed parallel to the waveguide's shorter cross-sectional dimension, wherein the providing includes:

forming the first half of the hollow waveguide from at least one lower machined plate; and forming the second half of the hollow waveguide from at least one upper machined plate;

wherein the method also comprises:

forming a radiating element layer including an array of radiating elements each having a center, wherein the distance between the centers of adjacent elements in the array is less than one wavelength;

forming an E-orientation feeding network layer comprising:

E-plane splitters operative to receive the electromagnetic wave from the antenna input and defining multiple feeding network outputs, wherein each E-plane splitter is made of first and second halves which are included in the upper and lower plates respectively; and waveguide sections interconnecting the E-plane splitters; and forming, in the upper plate, an H-plane splitter layer below the radiating element layer and including H-plane splitters, each having an H-plane splitter input facing the lower plate and a pair of H-plane splitter outputs which respectively connect the H-plane splitter to a pair of the radiating elements.

Embodiment 13. A method according to any of the preceding embodiments wherein the forming is performed by a molding machine.

Embodiment 14. A method according to any of the preceding embodiments wherein the forming is performed by a 3-axis CNC machine.

Embodiment 15. Antenna apparatus according to any of the preceding embodiments wherein there is no undercut in the upper plate.

Embodiment 16. Antenna apparatus according to any of the preceding embodiments wherein the upper machined plate is bonded to the lower machined plate.

Embodiment 17. A method according to any of the preceding embodiments wherein the upper machined plate is bonded to the lower machined plate.

It is appreciated that the waveguide sections need not be uniform in length; for example, the lengths of the waveguide sections may be set to generate beam tilt as is known in the art.

The embodiments referred to above, and other embodiments, are described in detail in the next section.

Any trademark occurring in the text or drawings is the property of its owner and occurs herein merely to explain or illustrate one example of how an embodiment of the invention may be implemented.

Elements separately listed herein need not be distinct components and alternatively may be the same structure. A statement that an element or feature may exist is intended to include (a) embodiments in which the element or feature exists; (b) embodiments in which the element or feature does not exist; and (c) embodiments in which the element or feature exist selectably e.g. a user may configure or select whether the element or feature does or does not exist.

BRIEF DESCRIPTION OF THE DRAWINGS

Certain embodiments of the present invention are illustrated in the following drawings.

Figure 1A:
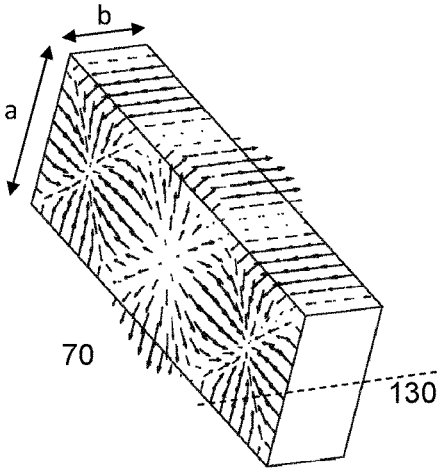
FIG. 1*a* is a schematic isometric view of a waveguide which depicts electric currents along the walls of the waveguide, generated by an electromagnetic wave travelling through the waveguide.

In the drawings, black lines may denote transition between conductive substrates and empty spaces.

DETAILED DESCRIPTION OF CERTAIN EMBODIMENTS

FIG. 1*a* depicts currents along the walls of a waveguide, generated by an electromagnetic wave travelling along the waveguide. Each arrow represents the direction of current; FIGS. 3*b*-7*b* illustrates antenna construction according to certain embodiments of the present invention.

Figure 4A:
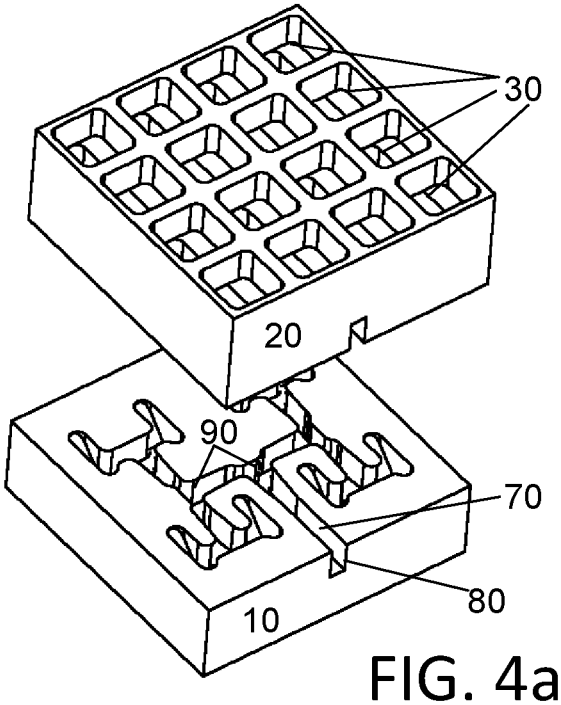
FIG. 4*a* is a top perspective exploded view of an antenna formed from two plates.
Figure 4B:
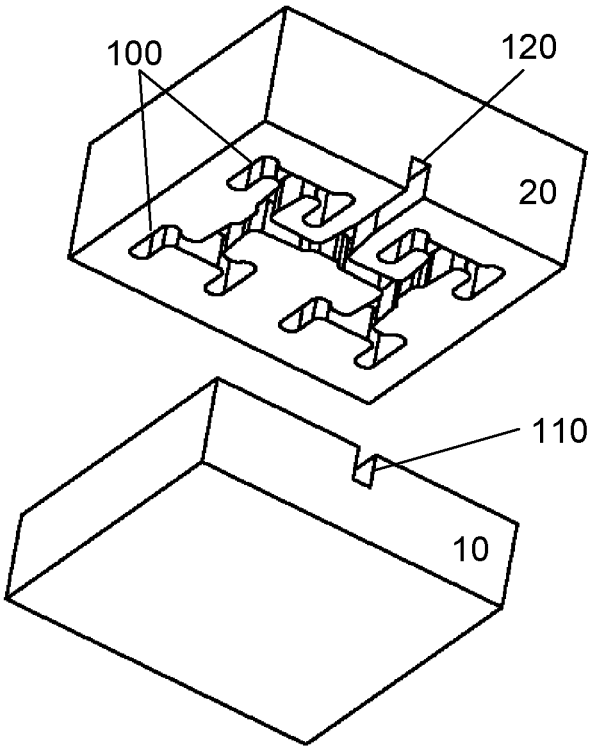
FIG. 4*b* is a bottom perspective exploded view of an antenna formed from two plates.
Figure 5:
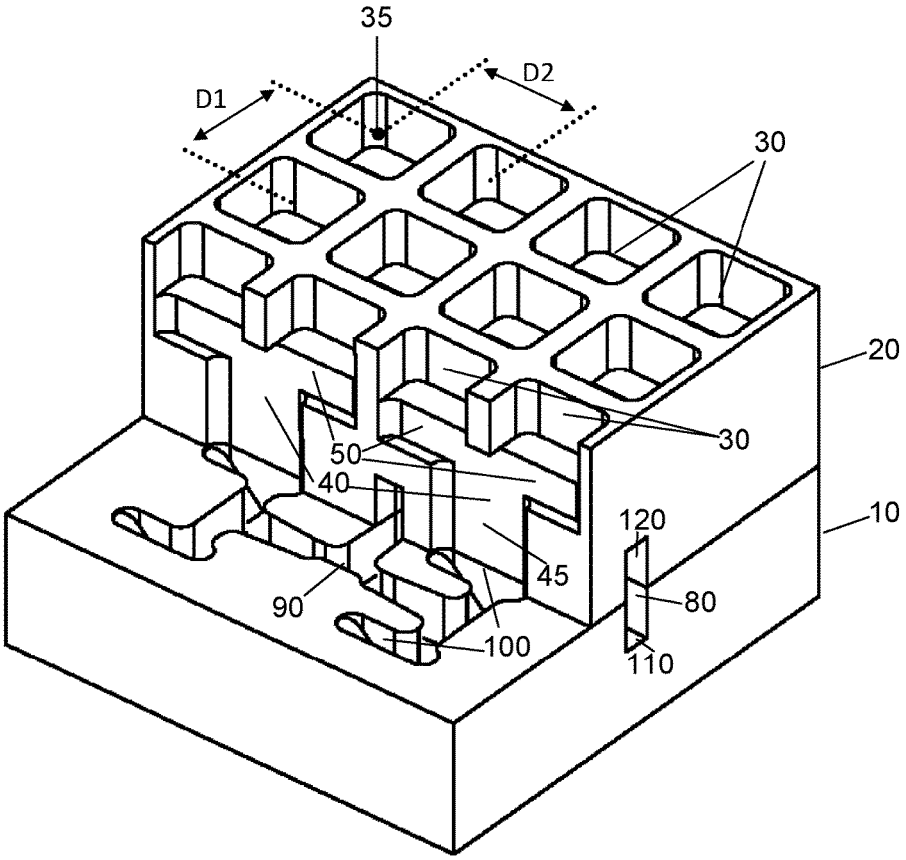
FIG. 5 is an isometric cut-away view of an antenna formed from two plates.

As shown in FIG. 4*a*, 4*b*, 5, the antenna typically comprises two plates 10 and 20 lower and upper. Typically the lower plate includes the lower half of the waveguides (110) of the feeding network and the upper plate includes radiating elements 30, H-plane splitters 40, and the upper half of the waveguides (120) of the feeding network.

Typically, each feeding network output (100) connects to only two radiating elements and generally, the above three elements (30, 40, and 120), in the upper plate, are designed so as not to contain undercuts to facilitate manufacturing in a single plate using a simple molding machine or a 3-axis CNC machine.

Typically, there is no undercut in the lower plate.

In the completed antenna, the two machined plates are typically suitably bonded.

According to certain embodiments, exactly half of a waveguide is formed from one plate and the other half is formed from another plate. According to certain embodiments, the division into halves is obtained by bisecting the longer waveguide dimension "a".

A particular advantage of manufacturing exactly half of the waveguide from one plate and the other half from another plate, where the division into halves is obtained by bisecting the longer waveguide dimension, is that the division-line 130 does not cross any currents as is apparent e.g. from FIG. 1*a;* it does not disturb the wave's progress along the waveguide, because the currents adjacent to the division-line are parallel to the wave propagation direction hence to the division-line. Therefore the two plates need not be soldered to one another (since it is not necessary to ensure that the separation between the 2 plates be zero). Instead, the two plates may, for example, simply be screwed together, despite the resulting 0.1 mm (say) separation between the plates (e.g. as indicated by the screw-holes 77 shown in FIG. 7*b*, whose locations are of course not intended to be limiting). Other bonding methods may be welding, soldering, and Laser bonding. This is advantageous e.g. because soldering may be more costly relative to screws, hence its elimination reduces the per-piece manufacturing cost of the antenna. In addition welding or soldering could cause distortion in the plates due to heating effects.

According to certain embodiments, an antenna array for transmitting/receiving electromagnetic radiation defining a wavelength is provided, the array comprising:

- at least one lower machined plate 10 and at least one upper machined plate 20 which is typically bonded to the lower machined plate. Upper plate 20 may include:
  - a radiating element layer including an array of radiating elements 30 each having a center 35, wherein the distance between the centers of adjacent elements 30 in the array is less than one wavelength; and
  - an H-plane splitter layer, below the radiating element layer, which includes H-plane splitters 40 each having an H-plane splitter input 45 facing the lower plate and a pair of H-plane splitter outputs 50 which respectively connect the H-plane splitter 40 to a pair of radiating elements 30.

An E-orientation feeding network layer 60 may comprise:

a. a hollow rectangular waveguide 70 sections including first and second halves 110, 120 which are disposed on respective sides of a bisecting plane 130 parallel to the waveguide's shorter cross-sectional dimension and parallel to the wave propagation direction and which are included in the lower and upper plates respectively; and b. E-plane splitters 90 receiving a wave exiting the waveguide and defining multiple feeding network outputs 100, wherein an individual H-plane splitter input 45 connects individual ones of the H-plane splitters to respective outputs from among the multiple feeding network outputs 100, thereby to enable the h-plane splitters to split the electromagnetic radiation travelling from the feeding network input 80 to the radiating elements 30.

Typically, each E-plane splitter 90 is formed of first and second halves which are included in the lower and upper plates 10, 20 respectively.

Figure 6A:
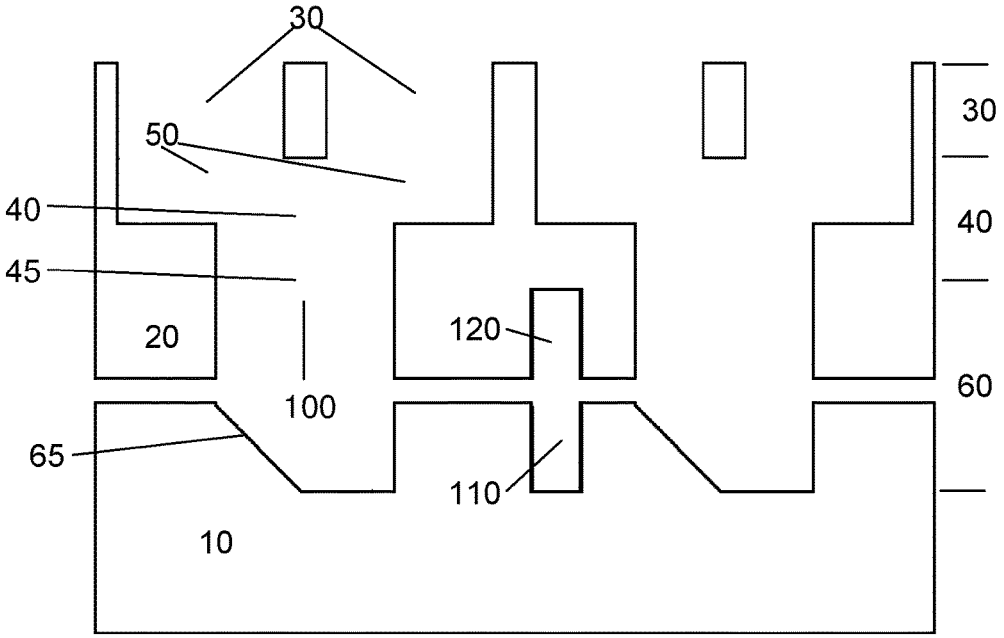
FIG. 6*a* is a cross-sectional view of an antenna formed from two plates.
Figure 6B:
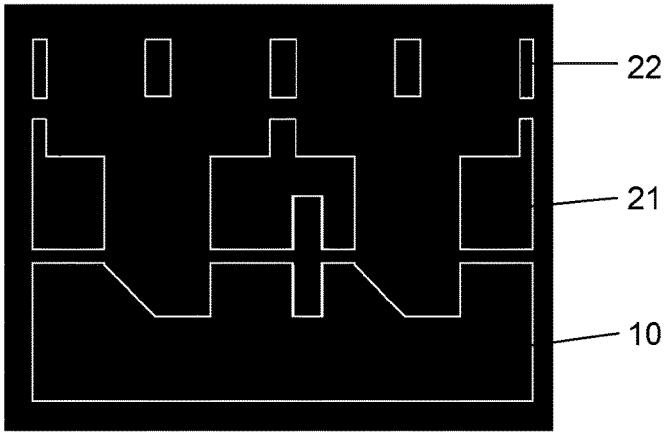
FIG. 6*b* is a cross-sectional view of an antenna formed from three plates.
Figure 7A:
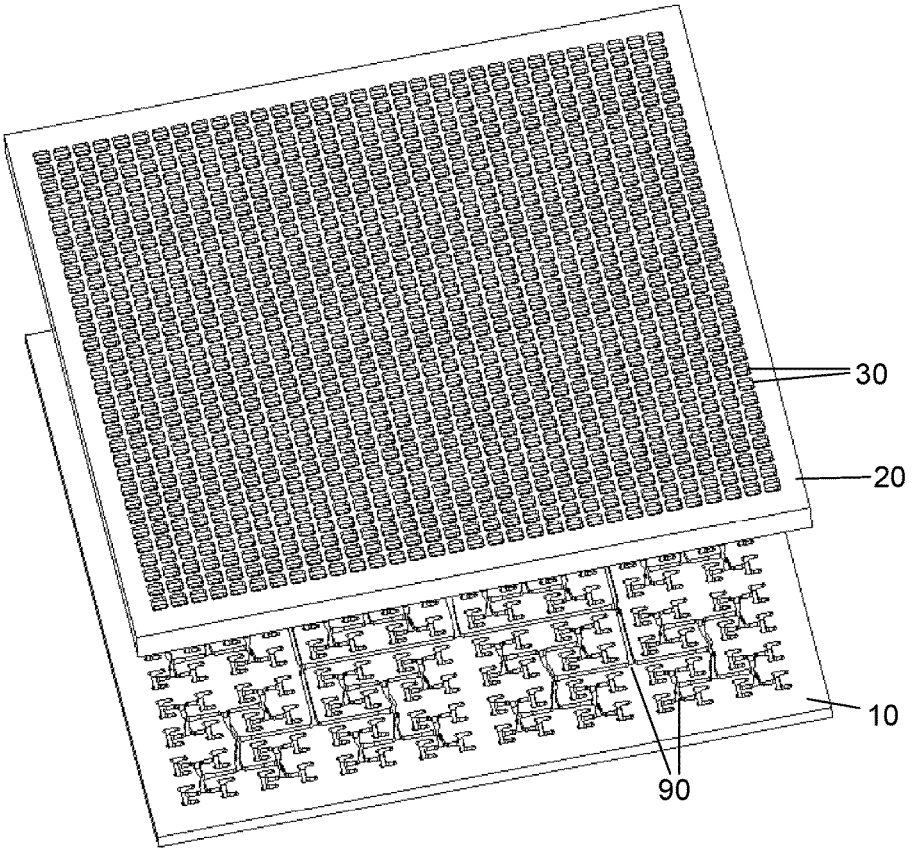
FIG. 7*a* is an exploded top isometric view of an antenna array formed from two plates.
Figure 7B:
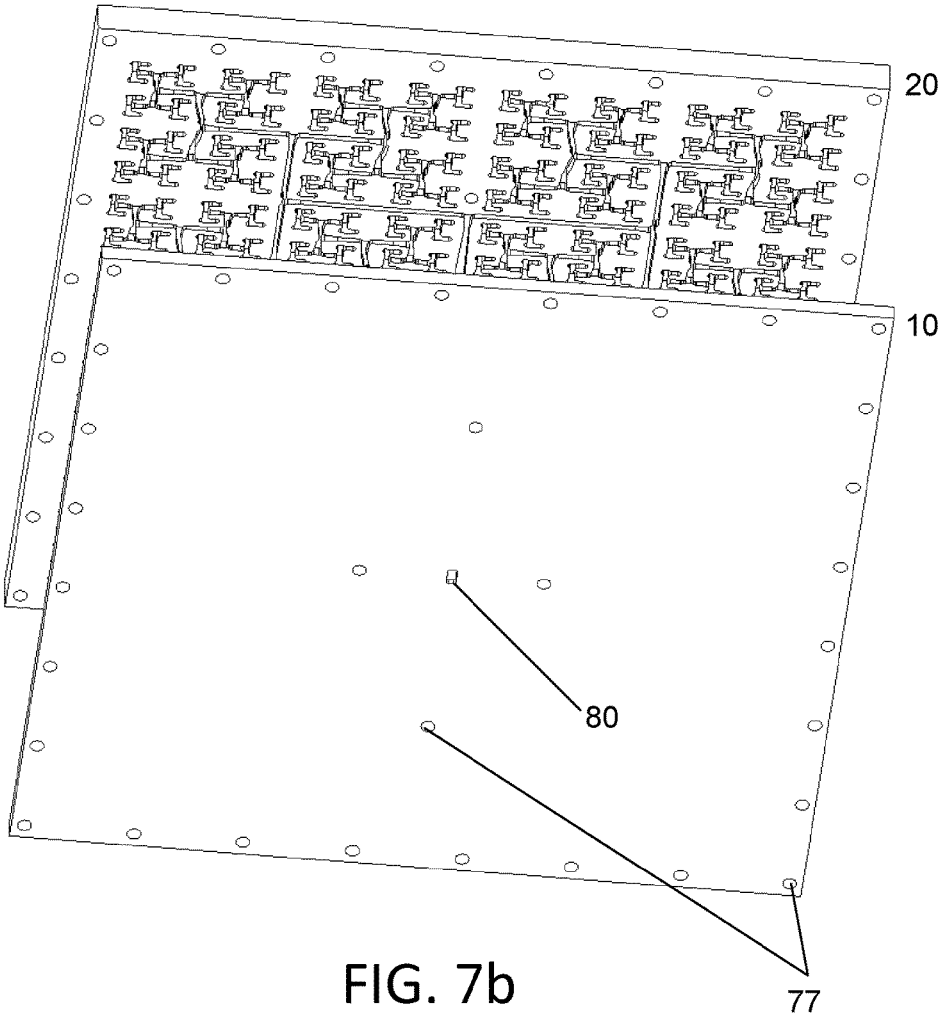
FIG. 7*b* is an exploded bottom isometric view of an antenna array formed from two plates.

According to some embodiments, e.g. as shown in FIGS. 4*a*-4*b*, exactly two machined plates are provided: a lower plate 10, and a single upper plate 20. Radiating elements 30, H-plane splitters 40 and the top half 120 of the feeding network 60 are included in the upper plate 20, and the bottom half 110 of the feeding network 60 (waveguide sections 70 and E-plane splitters 90) are included in the lower plate 10. However, according to certain embodiments, e.g. in applications in which it is important to ensure that each machined plate has a particularly simple form, there may be two upper plates—a middle plate adjacent the lower plate and a top-most plate atop the middle plate, such that the antenna includes a total of three machined plates (lower, middle, top-most). Typically, in this case, e.g. as shown in FIG. 6*b*, the lower plate 20 includes half of the feeding network 60 as in the single-upper-plate embodiment, the middle plate 21 includes half of the feeding network 60 and a bottom half of the h-plane splitter layer, and the top-most plate 22 includes a top-half of the h-plane splitters and the radiating element layer.

Figure 3:
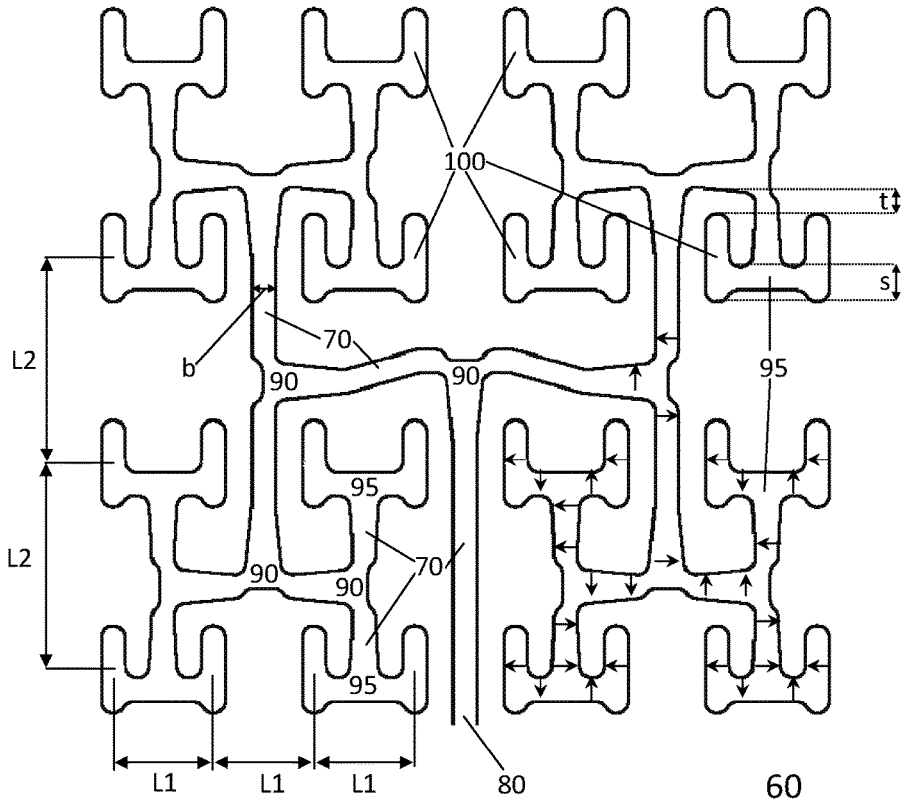
FIG. 3 is a top view of an example E-plane feeding network.

Components of the antenna, according to various embodiments, are now described in detail:

The Feeding network, e.g. as shown in FIG. 3, typically has one input 80 and multiple outputs 100. The feeding network 60 typically includes E-plane splitters 90 and rectangular waveguide sections 70 interconnecting them as shown.

The orientation of the waveguides of the feeding network 60 typically comprises an "E-plane orientation" in which the short cross sectional dimension of the rectangular waveguide 70 parallel to the feeding network plane.

Figure 1B:
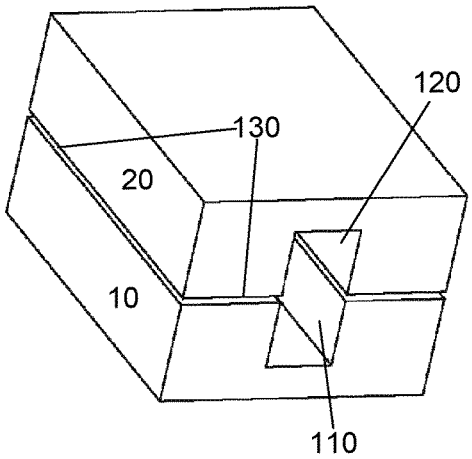
FIG. 1*b* is a schematic isometric view of a waveguide apparatus where the cut is parallel to the E field, the apparatus being formed from two plates.

Use of E-plane orientation for the waveguides of the feeding network 60 may yield one or more of the following advantages:

a. The ability to divide the waveguide 70 into two plates 10, 20 without crossing the electric current runs on the waveguide walls. When we split the waveguide 70 equally between the two plates as shown in FIG. 1*b* the division line 130 is parallel to, hence does not cross, the electric currents that run along the waveguide walls as illustrated in FIG. 1*a*, hence do not disturb the wave as it propagates through the waveguide. In contrast, at H-orientation the division line would always cross the electric current and therefore might disturb the wave as it propagates through the waveguide. In fact, the split of the waveguide 70 between the two plates does not disturb the wave, even if the two plates of the antenna are merely close to each other without actually touching one another. Therefore, the two plates of the antenna may be joined, say by screws, rather than soldering the plates together.

b. According to certain embodiments, the feeding network is constructed to yield an L1 of less than one wavelength and L2 of less than two wavelengths in order to achieve a distance of less than one wavelength between adjacent radiating elements. If the waveguide is too wide (b is too large) then the conductive wall between the waveguide channels may be so narrow as to be extremely costly to produce. Therefore an advantage of the E-plane feeding network is that the waveguide width which is present at the feeding network plane is "b". In contrast the width which is present at an H-plane network is "a". Hence, the waveguide width in an E-plane network is half that in an H-plane network. Moreover the b dimension of the waveguide does not affect the cutoff frequency of the waveguide such that b can be less than a/2 e.g. for example any value from 0.1a to 0.5a. By reducing the width of the waveguides of the feeding network 60 the feeding network 60 may drive any pair of radiating elements 30 and still have a conductive wall of reasonable thickness between the waveguides channels. The ability to drive the feeding network to any pair of radiating elements affords an option of using a 1 to 2 splitter between the feeding network and the radiating elements. By contrast with an H-plane feeding network the feeding network cannot drive any pair of radiating elements because the waveguide channels intersect each other. Therefore in the case of an H-plane network the feeding network drives any four radiating elements and then 1 to 4 splitters must be employed between the feeding network and the radiating elements.

A particular advantage of certain embodiments is use of 1 to 2 splitters between the feeding network 60 and the radiating elements 30 instead of 1 to 4 splitters e.g. as in US prior art patent applications US20130120205 and US20130321229. The advantage of using 1 to 2 splitters is that 1 to 2 splitters with the radiating elements and the upper side of the feeding network does not contain undercuts so it can easily be manufactured in one plate, e.g. as shown in FIGS. 5, 6*a*. By contrast 1 to 4 splitters with the radiating elements and the upper side of the feeding network contain undercuts which are difficult to produce in one plate.

A particular advantage of certain embodiments is offsetting the connection point between the last-level E-plane splitters 95 to the feeding network output 100, referenced 's' in FIG. 3. As apparent from FIG. 3 this offset directly affects the wall thickness t. As s diminishes, the feeding network outputs 100 moves upwards thus 't' become smaller. When 's' is zero, e.g. as in US prior art patent U.S. Pat. No. 4,743,915, the wall thickness 't' become so small that manufacturing becomes difficult.

According to certain embodiments, the feeding network 60 of FIG. 3 overcomes the problem of E-plane splitters undesirably inverting the phase of the wave at one of the plural E-plane splitter 90 outputs. In FIG. 3, the electric field direction is represented by the arrow's orientation and phase is represented by the arrow-heads. As shown, all the outputs of the feeding network 100 (those which connect to the H-plane splitters) are in phase. In the illustrated embodiment, the arrows respectively representing the electric fields at four feeding network outputs 100 all point to the left, although this is not intended to be limiting. The electric field direction and phase of the all other outputs 100 are identical to those four outputs.

Any suitable feeding network dimensions may be employed and FIG. 3 is therefore not necessarily to scale. Example dimensions:

| | Freq [GHz]/wavelength[mm] | | | |
|---|---|---|---|---|
| | 11/27.3 | 30/10 | 60/5 | 80/3.75 |
| a [mm] | 17 | 7.5 | 3.75 | 2.7 |
| b [mm] | 9 | 2.5 | 1 | 0.8 |
| L1 [mm] | 23 | 8.5 | 4.3 | 3.2 |
| L2 [mm] | 46 | 17.4 | 8.8 | 6.6 |
| D1 [mm] = L1 | 23 | 8.5 | 4.3 | 3.2 |
| D2 [mm] = L2/2 | 23 | 8.7 | 4.4 | 3.3 |
| s [mm] | 6 | 3 | 1.5 | 1.1 |
| t [mm] | 1.5 | 1.3 | 1 | 0.8 |

A particular advantage of the above embodiment is that the distance between adjacent elements is of less than one wavelength.

Optionally, some or even all of the e-plane splitters may split the power unequally such that one output gets more than half of the power in the splitter input, and the second output get less than half of the input power. Alternatively, some or even all of the e-plane splitters may split the power equally such that one output gets exactly half of the power.

Figure 2A:
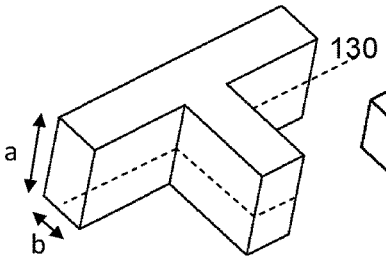
FIG. 2*a* is a schematic drawing of an example E-plane splitter.
Figure 2B:
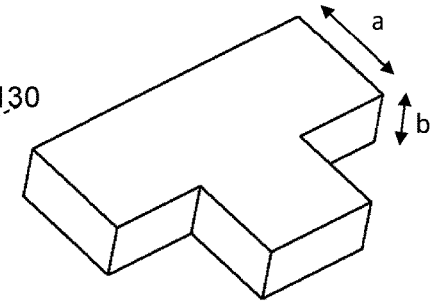
FIG. 2*b* is a schematic drawing of an example H-plane splitter.

The H-plane splitters e.g. as shown in FIGS. 2*b*, 6*a*, typically have one input and two outputs. Each output 100 of the feeding network 60 is connected to an input 45 of H-plane splitter 40.

Any suitable conventional H-plane splitter configuration may be employed. Typically, an H-plane splitter 40 is connected to each output 100 of the feeding network 60. The outputs 50 of the H-plane splitter 40 connect to a pair of radiating elements 30.

Typically, a radiating element 30 (e.g. horn e.g. as shown in FIGS. 4*a*, 5, 6*a*, 7*a*) is provided to connect to every output 50 of the H-plane splitters. Any suitable number of radiating elements 30 may be employed e.g. between 4 and 100000.

Typically, each radiating element 30 has one input and one output. The input of each radiating element is connected to the output of an H-plane splitter. The output of the radiating element 30 radiates the wave into space.

The distances D1 and D2 (FIG. 5) between each two adjacent radiating elements 30 along the two dimensions of the array of radiating elements respectively, are each typically less than one wavelength in order to reduce side lobes levels and avoid high side lobes. This is achievable e.g. due to the design and dimensions of the feeding network 60 as shown herein and/or due to presence of H-plane splitters between the outputs of the feeding network 60 and the radiating elements 30 e.g. horns.

The radiating elements 30 may have any suitable configuration: horn (tapered), box horn, rectangular and may have the same dimension as the h-plane splitter output 50 such that the surfaces of the H-plane splitter 40 and radiating elements are continuous.

Particular features which are provided according to certain embodiments are now described in detail:

As shown in FIG. 1*a*, the bisecting plane 130 which defines the two wave-guide halves, bisects the long dimension of the waveguide's cross-section so as not to cross the waveguide's wall electric currents.

In FIGS. 2*a* and 2*b*, a, b are the dimensions of the waveguide's cross-section. Typically, b=0.26*a or a value closer to 0.25*a than to 0.5*a, to save space. However, this is not intended to be limiting. For example, b=0.5*a or even 0.6*a or 0.7*a might be appropriate ratios e.g. at longer wavelengths. Alternatively, b might be even less than 0.26*a e.g. 0.1*a.

In FIG. 3, typically, the spacing L1 between vertically adjacent elements 30 in FIG. 3 is less than one wavelength. In FIG. 3, L1 is drawn as the distance between corresponding locations in vertically adjacent elements 30.

Typically, the spacing L2 between horizontally adjacent elements 30 in FIG. 3 is less than 2 wavelengths. In FIG. 3, L2 is drawn as the distance between corresponding locations in horizontally adjacent elements 30.

In FIG. 3, the waveguide 70 walls are shown schematically as straight. However, as is known in the art, the short dimension, b, of the waveguides shown in FIG. 3 may vary along the waveguide, e.g. in the region where the waveguide 70 connects to the E-plane splitters. It is appreciated that the curvature of the e-plane splitters, as well as the waveguide 70 cross-sectional dimensions a, b are not intended to be limiting.

As shown in FIG. 6*a*, optionally, the output 100 of the feeding network may include a slanted surface 65 at its bottom, to facilitate passage of the wave from feeding network output 100 to h-plane splitter input 45.

As shown in FIG. 6*b*, an antenna may include a bottom plate, a middle plate and a top-most plate. Typically, the radiating element layer is included in the top-most plate; the first and second portions of the H-plane splitter layer are included in the middle and top-most plates respectively; the hollow rectangular waveguide's first and second halves are included in the middle and lower plates respectively; and each E-plane splitter's first and second halves are included in the middle and lower plates respectively. The antenna shown in FIGS. 7*a*-7*b* includes 2 plates, 1024 radiating elements 30, 512 H-plane splitters, 511 E-plane splitters and a waveguide section 70 intermediate to each E-plane splitter's output and the following E-plane splitter 90 input. However, this is not intended to be limiting. For example, any suitable number of radiating elements 30 may be used, even as few as 4 such elements.

Typically, the antenna is symmetric such that the length of the path that the wave travels from the feeding network input 80 to any one of the outputs 100 is always identical, hence the phases of the wave on each of the outputs are identical, although this is not intended to be limiting. For example the waveguide section lengths may be changed to yield beam tilt, as is known in the art.

Typically, the E-plane splitters are arranged to form a parallel feeding network having a binary tree form. For example, in the example of FIG. 7, 512 H-plane splitters may be connected to 256 E-plane splitters which may respectively be connected to 128 E-plane splitters which may respectively be connected to 64 E-plane splitters which may respectively be connected to 32 E-plane splitters which may respectively be connected to 16 E-plane splitters which may respectively be connected to 8 E-plane splitters which may respectively be connected to 4 E-plane splitters which may respectively be connected to 2 E-plane splitters which may respectively be connected to a single E-plane splitter 90 connected directly to the antenna input (e.g. 80 in FIG. 7*b*). However, this again is not intended to be limiting. For example, the binary tree need not be "full" e.g. it is possible that one of the outputs of a certain E-plane splitter 90 is split further by a next-level E-splitter, and the other output is not split. In other words, the number of radiating elements 30 does not have to be a power of 2.

It is appreciated that terminology such as "mandatory", "required", "need" and "must" refer to implementation choices made within the context of a particular implementation or application described herein for clarity and are not intended to be limiting since in an alternative configuration, the same elements might be defined as not mandatory and not required or might even be eliminated altogether.

The scope of the present invention is not limited to structures and functions specifically described herein and is also intended to include devices which have the capacity to yield a structure, or perform a function, described herein, such that even though users of the device may not use the capacity, they are if they so desire able to modify the device to obtain the structure or function.

Features of the present invention, including method steps, which are described in the context of separate embodiments may also be provided in combination in a single embodiment. For example, a system embodiment is intended to include a corresponding process embodiment. Features may also be combined with features known in the art and particularly although not limited to those described in the Background section or in publications mentioned therein.

Conversely, features of the invention, including method steps, which are described for brevity in the context of a single embodiment or in a certain order may be provided separately or in any suitable minor configuration, including with features known in the art (particularly although not limited to those described in the Background section or in publications mentioned therein) or in a different order. "e.g." is used herein in the sense of a specific example which is not intended to be limiting. Each method may comprise some or all of the steps illustrated or described, suitably ordered e.g. as illustrated or described herein.

It is appreciated that in the description and drawings shown and described herein, functionalities described or illustrated as systems and sub-units thereof can also be provided as methods and steps therein, and functionalities described or illustrated as methods and steps therein can also be provided as systems and sub-units thereof. The scale used to illustrate various elements in the drawings is merely exemplary and/or appropriate for clarity of presentation and is not intended to be limiting.

The invention claimed is:

1. Antenna apparatus for transmitting/receiving electromagnetic radiation defining a wavelength, the apparatus comprising:

at least one lower machined plate; and at least one upper machined plate including:

a radiating element layer including an array of radiating elements each having a center, wherein the distance between the centers of adjacent elements in said array is less than one wavelength; and an H-plane splitter layer below said radiating element layer and including H-plane splitters each having an H-plane splitter input facing said lower plate and a pair of H-plane splitter outputs which respectively connect the H-plane splitter to a pair of said radiating elements, and an E-orientation feeding network layer having an input and comprising:

E-plane splitters receiving the wave from the feeding network input and defining multiple feeding network outputs, wherein an individual H-plane splitter input connects individual ones of said H-plane splitters to respective outputs from among said multiple feeding network outputs, thereby to enable the H-plane splitters to split the electromagnetic radiation travelling from the feeding network input to the radiating elements, and wherein each E-plane splitter is formed of first and second halves which are included in the upper and lower plates respectively; and hollow waveguide sections interconnecting the E-plane splitters, and including first and second halves which are disposed on respective sides of a bisecting plane parallel to the waveguide's shorter cross-sectional dimension and which are included in the lower and upper plates respectively.

2. Antenna apparatus according to claim 1 wherein the radiating element layer, H-plane splitter layer and E-orientation feeding network layer are formed from only two machined plates.

3. Antenna apparatus according to claim 1 wherein the radiating element layer, H-plane splitter layer and E-orientation feeding network layer are formed by injection molding two machined plates.

4. Antenna apparatus according to claim 3 wherein the radiating element layer, H-plane splitter layer and E-orientation feeding network layer are formed by injection molding only two machined plates.

5. Antenna apparatus according to claim 1 wherein the E-plane splitters are arranged to form a parallel feeding network defining a binary tree comprising layers of splitters, each splitter in a layer n splitting an output of a splitter in layer (n−1) of said tree.

6. Antenna apparatus according to claim 1 wherein said at least one upper machined plate comprises a middle plate and a top-most plate, and wherein:

said radiating element layer is included in said top-most plate;

first and second portions of said H-plane splitter layer are included in said middle and top-most plates respectively; and said hollow rectangular waveguide's first and second halves are included in the middle and lower plates respectively; and each E-plane splitter's first and second halves are included in the middle and lower plates respectively.

7. Antenna apparatus according to claim 1 wherein there is no undercut in the lower plate.

8. Antenna apparatus according to claim 1 wherein at least one of said E-plane splitters has first and second outputs and is designed to split power unequally between said first and second outputs.

9. Antenna apparatus according to claim 1 wherein paths from the feeding network input to each of the outputs are equal in length so phases at all of said multiple feeding network outputs are identical.

10. Antenna apparatus according to claim 9 wherein said network layer comprises a full binary tree.

11. Antenna apparatus according to claim 1 wherein the upper machined plate is bonded to the lower machined plate.

12. Antenna apparatus according to claim 1 wherein there is no undercut in the upper plate.

13. Antenna apparatus according to claim 11 wherein said plates are screwed, rather than being soldered, to one another.

14. Antenna apparatus according to claim 1, wherein a connection point between a last-level E-plane splitter to a feeding network output is offset.

15. A method of manufacturing an antenna for transmitting/receiving electromagnetic radiation defining a wavelength and comprising:

providing a hollow waveguide made from first and second waveguide halves which are disposed on respective sides of a bisecting plane disposed parallel to the waveguide's shorter cross-sectional dimension, wherein said providing includes:

forming the first half of the hollow waveguide from at least one lower machined plate; and forming the second half of the hollow waveguide from at least one upper machined plate;

wherein the method also comprises:

forming a radiating element layer including an array of radiating elements each having a center, wherein the distance between the centers of adjacent elements in said array is less than one wavelength;

forming an E-orientation feeding network layer comprising:

E-plane splitters operative to receive the electromagnetic wave from the antenna input and defining multiple feeding network outputs, wherein each E-plane splitter is made of first and second halves which are included in the upper and lower plates respectively; and waveguide sections interconnecting said E-plane splitters; and forming, in the upper plate, an H-plane splitter layer below said radiating element layer and including H-plane splitters, each having an H-plane splitter input facing said lower plate and a pair of H-plane splitter outputs which respectively connect the H-plane splitter to a pair of said radiating elements.

16. The method according to claim 15 wherein said forming is performed by a molding machine.

17. The method according to claim 15 wherein said forming is performed by a 3-axis CNC machine.

18. The method according to claim 15 wherein the upper machined plate is bonded to the lower machined plate.

19. The method according to claim 15, comprising off-setting a connection point between a last-level E-plane splitter to a feeding network output.

* * * * *